United States Patent [19]

Lesmeister et al.

[11] 4,261,267

[45] Apr. 14, 1981

[54] FURNACE DOOR

[76] Inventors: Adrian Z. Lesmeister, 2504 Linwood SW., Cedar Rapids, Iowa 52404; David J. Maresh, 1251 3rd Ave. SE., Cedar Rapids, Iowa 52403

[21] Appl. No.: 23,069

[22] Filed: Mar. 23, 1979

[51] Int. Cl.[3] ..... F23M 7/00

[52] U.S. Cl. ..... 110/173 R; 110/175 R; 126/191

[58] Field of Search ..... 110/173 R, 173 C, 175 R, 110/175 A, 176; 126/191, 192, 193, 162; 99/393

[56] References Cited

U.S. PATENT DOCUMENTS

| | | | |
|---|---|---|---|
| 365,632 | 6/1887 | Read | 110/175 R |
| 366,733 | 7/1887 | Millett | 110/173 R |
| 656,404 | 8/1900 | Harris . | |
| 704,359 | 7/1902 | McGurrin . | |
| 905,502 | 12/1908 | Conley . | |
| 1,220,718 | 3/1917 | Bibb | 110/173 R |
| 1,269,450 | 6/1918 | Isgett | 110/175 R |
| 1,320,960 | 11/1919 | Anderson | 110/175 A |
| 1,408,867 | 3/1922 | Dean | 110/175 R |
| 2,403,941 | 7/1946 | MacLaren | 110/173 R |
| 3,859,903 | 1/1975 | Kipp | 99/393 |
| 3,976,000 | 8/1976 | Oxel | 99/393 |

*Primary Examiner*—Henry C. Yuen
*Attorney, Agent, or Firm*—Hosier, Niro & Daleiden

[57] ABSTRACT

The improved furnace of this invention may be used to produce heat by the burning of wood or other combustible matter. The furnace has a combustion chamber with a generally vertical axis and a chamber access door for loading combustible matter into the furnace. The access door in its normally closed position lies in a plane extending upwardly and outwardly from the axis of the chamber. A smoke limiting means which is positioned above the access door extends to the plane of closure of the door. This smoke limiting means limits the escape of smoke and other combustion products when the access door is open. The smoke limiting means may have a port for visually observing the interior of the chamber and for admitting a poker therein. An air injector extending through the door directs air to the burning material within the combustion chamber. The access door may have attached to it a grate extending into the chamber for holding the combustible material as it burns. The grate moves with the door making it easier to load fresh combustible matter onto the grate when the door is open and also shaking down previously burned material from the grate as the door is opened and closed. Finally, the furnace may be adapted with a latch means which automatically engages as the access door is opened but requires manual operation for release thereby preventing accidental closure of the door.

7 Claims, 4 Drawing Figures

FURNACE DOOR

BACKGROUND OF THE INVENTION

Manually loaded furnaces for burning wood and other solid combustible matter have been known and used for many years. Generally these furnaces comprise a chamber for holding the combustible matter and for radiating the heat produced therefrom, as well as an access door for adding combustible material to the chamber and means for exhausting the products of combustion.

Numerous ornamental and utilitarian changes have been made in these furnaces over the years. For example, some manually fed furnaces burning wood and other solid combustible materials have been fitted with automatic stoking devices. In many applications, the advent of ready supplies of natural gas and fuel oil has eliminated the use of both manually fed and automatically stoked furnaces burning solid combustible matter altogether.

Nevertheless, manually fed furnaces burning wood and other solid combustible matter still have an important role to play. These furnaces can be used to produce heat from renewable resources like wood or combustible trash. Properly designed furnaces can operate for twelve hours or longer on a single load of solid combustible material, thus making automatic stoking unnecessary.

While it cannot be denied that manually loaded furnaces burning wood and other solid combustible material are environmentally desirable and practical in many applications, those using these furnaces do experience some inconvenience. In particular, one opening an access door to a furnace already containing a burning combustible material will be met by a gust of smoke and other combustion by-products. The loading of combustible material into the furnace chamber itself is often awkward and backbreaking. Removal of spent combustible material from its supporting grate within the furnace chamber is a messy chore.

While the prior art has failed to overcome these problems, the present invention represents an important contribution to the art by providing useful, novel solutions.

SUMMARY OF THE INVENTION

The present invention is directed to an improved furnace for producing heat by the burning of wood and other solid combustible matter. The furnace is manually fed through a readily opened access door. Air for combustion is admitted through an air injector which extends through the access door. Combustible material may be conveniently loaded onto the furnace grate when the access door is open without reaching into the combustion chamber. Smoke limiting means are provided to limit the escape of smoke and other combustible products from the furnace when the access door is open for feeding. Means are also provided for readily dislodging spent combustible material from the grate within the combustion chamber, for observing the interior of the combustion chamber and for inserting a poker into the chamber when necessary. Finally, a safety latch means is provided which simply and automatically holds an open access door in its open position but requires manual release in order to close the door thereby preventing accidental closure and injury.

It is an object of the present invention to provide a furnace for producing heat by the combustion of wood and other solid combustible matter having means limiting the escape of smoke and other combustible products from the furnace when its access door is opened.

It is another object of the present invention to provide a furnace with an access door lying in a plane extending outwardly and upwardly from the generally vertical axis of the furnace combustion chamber thereby shifting the center of gravity of the access door away from the wall of the chamber to reduce the force necessary to open the door.

It is yet another object of the present invention to provide a furnace with a grate attached to the inside of the access door in order to permit ready access to the grate when the door is opened and also thereby facilitating the shake-down of spent material from the grate as the door is opened and closed.

It is yet another object of the present invention to provide a furnace with an access door having latch means automatically engaging the door as it is opened but requiring manual release to permit the door to be closed thereby preventing accidental closure thereof.

In a preferred embodiment of the invention the furnace comprises a combustion chamber having a generally vertical axis and being defined by at least one wall. The chamber wall has a chamber access door adapted to be moved from a normally closed position to an open position to allow combustible matter to be fed into the chamber. When the door is in its closed position it lies in a plane extending upwardly and outwardly from the vertical axis of the chamber which shifts the center of gravity of the door away from the wall of the chamber thereby reducing the force necessary to open the door. The furnace also includes means associated with the chamber which limits the escape of smoke and other combustion products when the access door is open. The smoke limiting means is positioned above the access door and extends to the plane in which the access door lies.

BRIEF DESCRIPTION OF THE DRAWINGS

The various objects and advantages of the invention will become apparent upon reading the following detailed description and upon reference to the drawings, in which.

While the invention may be described below in connection with a preferred embodiment, it is to be understood that the claimed invention is not intended to be limited to the embodiment described. It is rather intended that all alternatives, modifications and equivalents be covered insofar as they may be included within the spirit and scope of the invention as defined in the appended claims.

DETAILED DESCRIPTION OF THE INVENTION

Figure 1:
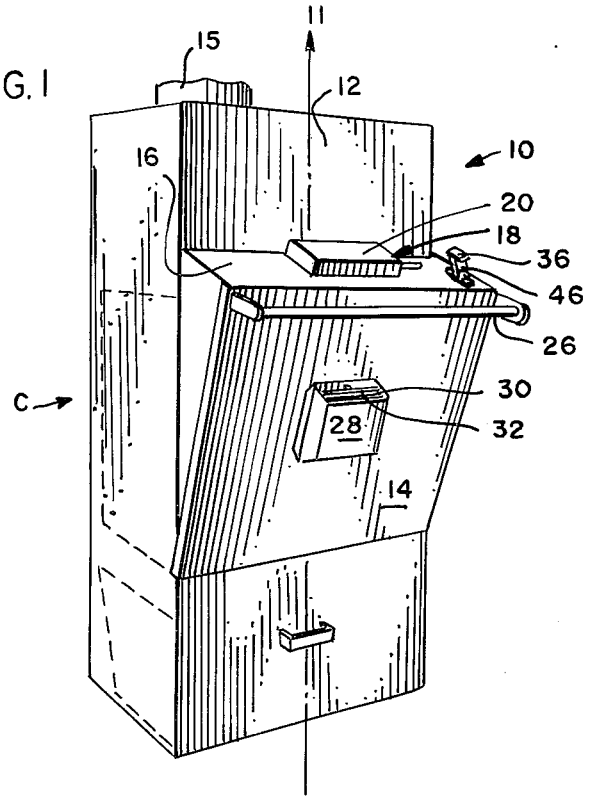
FIG. 1 is a perspective view of a furnace in accordance with the present invention.

In the illustration given and with reference first to FIG. 1, the numeral 10 designates generally a furnace in accordance with the present invention. The furnace 10 includes a chamber C defined by a wall 12 encircling the chamber which has a generally vertical axis 11. The furnace 10 also has an ash pit positioned below the chamber for collecting and removing spent combustible matter and a smoke stack 15 positioned above the chamber for exhausting smoke and other combustion by-products.

The chamber wall 12 has an access door 14 resting in a plane of closure extending upwardly and outwardly from the generally vertical axis 11 of the chamber. This position of the door 14 shifts its center of gravity outwardly relative to the wall 12 of the chamber thereby reducing the force necessary to open the door 12 as will be explained in greater detail below.

The furnace 10 includes a smoke limiting means comprising a shelf 16 positioned above the access door 14 and extending outwardly and downwardly between the wall 12 and the plane of closure of the access door 14. The combustion limiting means limits the escape of smoke and other combustion products from the furnace when the access door is opened as, for example, when combustible matter is being added to a fire already burning within the furnace.

The smoke limiting means 16 includes a port 18 which is sealed by a cover 20. The cover 20 may be opened to permit visual observation of the interior of the chamber defined by the wall 12. Opening the door 20 also permits access to the interior of the chamber with a poker (not shown) which may be necessary to manipulate the combustible material within the furnace to improve the burning thereof. In some cases it may be desirable to prop the cover 20 open to increase the amount of air entering the chamber.

Figure 2:
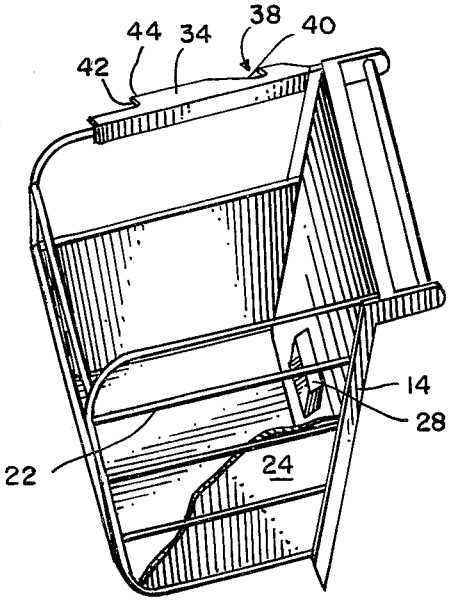
FIG. 2 is a perspective view of the access door of FIG. 1 showing the grate attached thereto.
Figure 3:
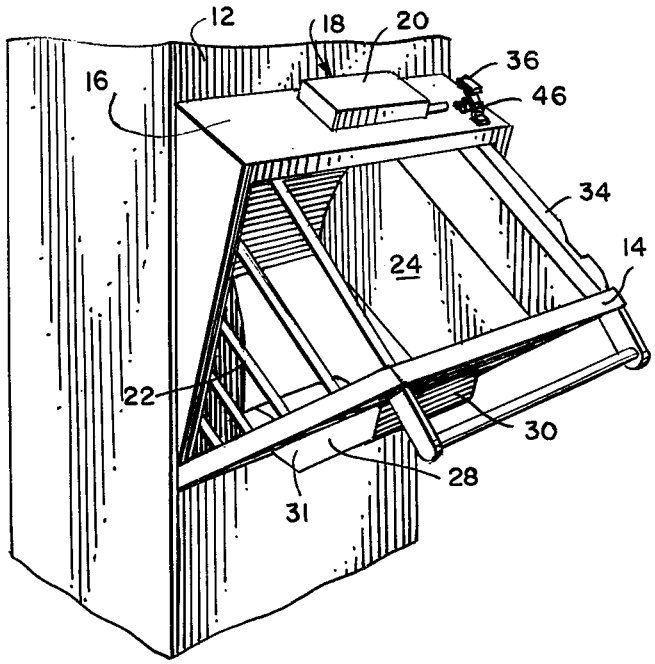
FIG. 3 is a perspective view of a portion of the furnace of FIG. 1 showing, in particular, the access door being held in an open position by the latch means and the air injector which extends through the door.

Turning now to FIGS. 2 and 3, the grate 22 attached to the inner surface of the access door 14 is shown. The grate 22, is shown in these figures with one of its skirts 24 partially removed for clarity. These skirts 24 prevent material from falling out of the sides of the grate as the access door 14 is opened or closed. Also shown in FIGS. 2 and 3 are the slotted bracket 34 and the locking bar 36 of the latch means.

The access door 14 is opened by pulling the handle 26 which is affixed to the door. Due to the inclined position of the door 14 when closed and at rest, the amount of force necessary to open the door is decreased over that which would be necessary to open it from a vertical closed position. This reduction in the required opening force is due to the shift of the center of gravity of the door and grate combination in the direction of the wall 12 of the furnace.

The access door 14 and grate 22 attached thereto move together as a unit. Therefore, when the access door 14 is opened, the grate 22 which normally rests within the chamber of the furnace 10 is simultaneously at least partially withdrawn from the chamber to permit easy loading of solid combustible material. Also, as the door 14 is opened and closed, spent combustible material on the grate will be shifted back and forth and thereby dislodged from the grate 22 and caused to fall from the grate and into the ash pit drawer.

Figure 4:
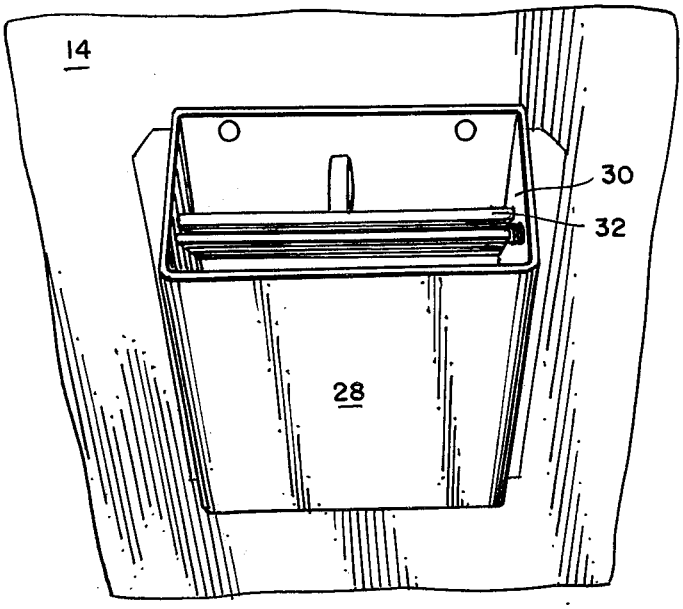
FIG. 4 is an enlarged perspective view of the air injector in the access door of FIG. 2 as viewed from the front of the door.

The access door includes an air-injector means 28 which extends through the door 14. The air injector means is best seen in FIGS. 2–4. The air-injector has an opening 30 external to the furnace chamber. Air is admitted through this opening and directed through a conduit 31 to the area above the combustible matter lying on the grate 22 to support the burning of the combustible matter. The escape of sparks and glowing embers is prevented by the conduit configuration and the normal consequent downdraft. The air-injector 28 includes in its opening 30 spring loaded adjustable damper means 32. The damper means 32 is automatically movable or manually manipulable to control the amount of air entering the chamber thereby regulating the rate of combustion of the combustible material lying on the grate 22.

The latch means, which is best seen in FIGS. 2 and 3, includes a slotted bracket 34 which is engaged by a locking bar 36. The slotted bracket 34 is affixed to the back of the access door 14 and the locking bar 36 is movably mounted on the shelf 16 so that it rests in a vertical position and can be pivoted in a plane perpendicular to the bracket 34. The slot 38 in the bracket 34 includes a cam surface 40 and a shoulder 42. As the door 14 is opened, the bar 36 is displaced from its vertical position as its lower portion rides along the cam surface 40. When the lower portion of the bar 36 reaches the intersection 44 of the cam surface 40 and the shoulder 42, it falls behind the shoulder 42 due to the force of gravity. Thus, when the door 14 is then released, the bar 36 engages the shoulder 42 thus preventing further closure. With the door in this open position combustible matter may be readily loaded onto the grate 22 without the danger of accidental closure. When it is desired to close the door 14, the upper portion 46 of the bar 36 is manipulated to pivot the lower portion 44 of the bar 36 out of the way of the bracket 34 thus permitting the door to be moved towards its normal resting position without impediment.

While in the foregoing specification a detailed description of the invention has been set forth for purposes of illustration, variation of the details may be made by those skilled in the art without departing from the spirit and scope of the appended claims.

We claim:

1. A furnace for producing heat by the burning of wood and other solid combustible matter comprising:

a combustion chamber generally adapted for containing within its interior the combustible matter, said chamber having a generally vertical axis and being defined by at least one wall, said wall having a chamber access door adapted to be moved from a normally closed position to an open position to allow combustible matter to be fed into said chamber, said door when in said closed position lying in a plane of closure extending upwardly and outwardly from said axis of said chamber, said door having in its normally closed position a center of gravity shifted outward relative to said wall of said chamber thereby reducing the force necessary to open said door;

a smoke limiting shelf associated with said chamber and said door for limiting the escape of smoke and other combustion products from said furnace when combustible material is burning within said chamber and said access door is in said open position, said smoke limiting shelf being positioned above said access door and extending outwardly and downwardly from said wall to said plane of closure of said access door;

a grate normally extending into said chamber for holding the combustible material as it burns, said grate being rigidly attached to said access door for movement with said door and at least partially out of said chamber as said door is opened for dislodging previously burned matter therefrom and for permitting easy access to said grate for loading combustible matter thereon; and air injector means extending through said access door for directing air from outside of said chamber to the area of said grate to support the burning of the combustible material lying thereon.

2. The furnace of claim 1 wherein said smoke limiting shelf includes a normally sealed port, said port when open permitting visual observation and poker access to the combustible matter contained within said combustion chamber.

3. The furnace of claim 1 wherein said air injector means includes damper means for regulating the quantity of air passing through said air injector means.

4. The furnace of claim 1 wherein said access door in its normally closed position and said grate attached thereto together have a center of gravity shifted outwardly relative to said wall of said chamber thereby reducing the force necessary to open said door.

5. The furnace of claim 1 including latch means adapted to automatically engage said door as it is opened to maintain said door in an open position but requiring manual release to permit said door to be closed thereby preventing accidental closure of said door.

6. The furnace of claim 5 wherein said latch means includes a slotted bracket attached to said door and a bar movably affixed to the furnace, said bar resting in a position in which it automatically engages the slots in said bracket as said door is opened, said bar being adapted to be disengaged from said slots by pivoting said bar clear of said bracket thereby permitting said door to be closed.

7. A furnace for producing heat by the burning of wood and other solid combustible matter comprising:

a combustion chamber generally adapted for containing within its interior the combustible matter, said chamber having a generally vertical axis and being defined by at least one generally vertical wall, said wall having a chamber access door adapted to be moved from a normally closed position to an open position to allow combustible matter to be fed into said chamber, said door when in said closed position lying in a plane of closure extending upwardly and outwardly from said axis of said chamber, said door having in its normally closed position a center of gravity shifted outward relative to said wall of said chamber thereby reducing the force necessary to open said door;

smoke limiting means associated with said chamber and said door for limiting the escape of smoke and other combustion products from said furnace when combustible material is burning within said chamber and said access door is in said open position, said smoke limiting means being positioned above said access door and extending to said plane of closure of said access door;

a grate normally extending into said chamber for holding the combustible material as it burns, said grate being rigidly attached to said access door for movement with said door and at least partially out of said chamber as said door is opened for dislodging previously burned matter therefrom and for permitting easy access to said grate for loading combustible matter thereon; and, air injector means extending through said access door for directing air from outside of said chamber to the area of said grate to support the burning of the combustible material lying thereon while preventing the escape of burning combustible matter through said access door as it is opened and closed.

* * * * *